US011318361B2

(12) United States Patent
Maeng et al.

(10) Patent No.: US 11,318,361 B2
(45) Date of Patent: May 3, 2022

(54) CLUB COVER HAVING VARIABLE INTERNAL SPACE

(71) Applicants: Seop Maeng, Gyeonggi-do (KR); Seoe Young Maeng, Seoul (KR)

(72) Inventors: Seop Maeng, Gyeonggi-do (KR); Seoe Young Maeng, Seoul (KR)

( * ) Notice: Subject to any disclaimer, the term of this patent is extended or adjusted under 35 U.S.C. 154(b) by 153 days.

(21) Appl. No.: 16/784,930

(22) Filed: Feb. 7, 2020

(65) Prior Publication Data

US 2021/0170249 A1 Jun. 10, 2021

(30) Foreign Application Priority Data

Dec. 9, 2019 (KR) ..... 10-2019-0162477
Jan. 21, 2020 (KR) ..... 10-2020-0007852

(51) Int. Cl.
*A63B 60/62* (2015.01)

(52) U.S. Cl.
CPC ..... *A63B 60/62* (2015.10); *A63B 2209/08* (2013.01)

(58) Field of Classification Search
CPC ..... A63B 60/62; A63B 2209/08
See application file for complete search history.

(56) References Cited

U.S. PATENT DOCUMENTS 2,779,374 A * 1/1957 Clarence ..... A63B 60/62 150/160
6,085,814 A * 7/2000 Choe ..... A63B 60/62 150/160
7,699,083 B1 * 4/2010 Kim ..... A63B 60/62 150/160
8,225,830 B2 7/2012 Maeng et al.
10,124,225 B2 11/2018 Maeng et al.
2005/0016648 A1 * 1/2005 Vakharia ..... A63B 60/62 150/160
2008/0060731 A1 * 3/2008 Hydorn ..... A63B 60/62 150/160
2013/0160908 A1 * 6/2013 Oliveiro ..... A63B 60/62 150/160

(Continued)

FOREIGN PATENT DOCUMENTS

KR 19990014426 A * 2/1999 ..... A63B 60/62
KR 100422101 B1 3/2004

(Continued)

OTHER PUBLICATIONS

English Abstract of KR100422101, Publication Date: Mar. 11, 2004.

*Primary Examiner* — Raleigh W Chiu
(74) *Attorney, Agent, or Firm* — Millen, White, Zelano & Branigan, PC; Ryan Pool

(57) ABSTRACT

A club cover having variable internal space is proposed by being configured to be flexible in an entrance space part thereof, through which a golf club head (hereinbelow referred to as "a club head") is inserted into and withdrawn from the club clover. More particularly, a club cover having variable internal space is proposed, wherein when a club head is inserted into the club cover, front and rear surfaces of a body part are brought close to each other to protect the club head, and when the club head is withdrawn, the front and rear surfaces of the body part are spaced apart from each other, so the club head is easily withdrawn and stored, and is safely stored without damage.

11 Claims, 16 Drawing Sheets

(56) References Cited

U.S. PATENT DOCUMENTS

| | | | | |
|---|---|---|---|---|
| 2015/0083291 | A1* | 3/2015 | Solheim | A63B 60/64<br>150/160 |
| 2020/0254317 | A1* | 8/2020 | Maeng | A63B 60/62 |
| 2021/0170249 | A1* | 6/2021 | Maeng | A63B 60/62 |

FOREIGN PATENT DOCUMENTS

| | | | |
|---|---|---|---|
| KR | 100958526 | B1 | 5/2010 |
| KR | 101757261 | B1 | 7/2017 |

* cited by examiner

CLUB COVER HAVING VARIABLE INTERNAL SPACE

CROSS REFERENCE TO RELATED APPLICATION

The present application claims priority to Korean Patent Application No. 10-2019-0162477, filed Dec. 9, 2019, the entire contents of which is incorporated herein for all purposes by this reference.

BACKGROUND OF THE INVENTION

Field of the Invention

The present invention generally relates to a club cover having variable internal space by being configured to be flexible in an entrance space part thereof, through which a golf club head (hereinbelow referred to as "a club head") is inserted into and withdrawn from the club clover. More particularly, the present invention relates to a club cover having variable internal space, wherein when a club head is inserted into the club cover, front and rear surfaces of a body part are brought close to each other to protect the club head, and when the club head is withdrawn, the front and rear surfaces of the body part are spaced apart from each other, so the club head is easily withdrawn and safely stored without damage.

DESCRIPTION OF THE RELATED ART

Generally, the size of the head of the golf club used as "a driver club" among the golf clubs has been about 300 cc in volume, but the size of the head of the golf club has gradually increased, and recently has been enlarged to a size of about 500 cc in volume. However, a club cover used to protect the surface of the club head could be manufactured up to a size of 350 cc when using materials such as flexible knit products. However, the club cover made of the knit products is not used at present as the volume of the club head is increasing to 500 cc.

Accordingly, currently, a club cover, which is sewn with a general fabric or synthetic resin leather, is used to cover a club head.

As for such a conventional club cover, as illustrated in FIG. 1, the size of an entrance space part of the club head arranged at a lower part of the club cover is considerably big such that the head is efficiently inserted to and withdrawn from the club cover when inserting the big head of a golf club into the club cover, which results in the entrance space part drooping. Accordingly, when multiple club heads covered by club covers are stored in a golf bag, interference between the entrance space parts of the club covers, which are drooped, occurs, which causes much inconvenience during use. A rubber band is provided at an upper end of the entrance space part such that the club head does not fall out. Such a rubber band makes the passing of the club head through a head storage space difficult, which causes the passing to take much time.

In addition, as illustrated in FIG. 2, there is proposed a conventional club cover A, the club cover including: a foldable part 14 provided in a body part 12, which the club head is inserted into and withdrawn from; and magnets M attached to the inner side of an outer fabric 14*b* of the foldable part 14. Accordingly, the entrance space part 13 of a golf club is expanded and contracted by the attachment and detachment of the magnets M. In the club cover A, the magnets M are attached to the inner surface of the foldable part 14. Accordingly, in a case that the magnets M are arranged at the inner side of the outer fabric 14*b* of the foldable part 14, and the outer fabric 14*b* is made of thick materials, the attaching force of the magnets M is not sufficiently exercised when the magnets M adjacent to each other are attached to each other since a distance between the magnets is configured to be large. Furthermore, since the distance W spaced apart between the magnets M is large, the attaching force between the magnets is weakened. Thus, to increase such an attaching force, multiple magnets are required to be used, which causes manufacturing cost to increase, and an open space of the foldable part 14 is increased due to the separation distance W defined in the foldable part 14 of the side surface of the body part 12 of the club cover A, so foreign materials are introduced into the club cover through the open space.

Documents of Related Art (Patent Document 1) Korean Patent No. 10-1757261

(Patent Document 2) Korean Patent No. 10-0958526

(Patent Document 3) Korean Patent No. 10-0422101

SUMMARY OF THE INVENTION

Accordingly, the present invention has been made keeping in mind the above problems occurring in the related art, and the present invention is intended to propose a club cover having variable internal space, wherein when a club head is inserted into the club cover, front and rear surfaces of a body part are brought close to each other to protect the club head, and when the club head is withdrawn from the club cover, the front and rear surfaces of the body part are spaced apart from each other, so the club head is easily withdrawn and safely stored without damage.

In order to achieve the above objectives, according to one aspect of the present invention, there is provided a club cover having variable internal space, the club cover including: a head storage space 11 provided at an upper part of the club cover, the head storage space storing the club head H; a body part 12 provided from a middle to a lower part of the club cover and which the club head is inserted into and withdrawn from; and an entrance space part 13 provided inside the body part 12, the entrance space part being configured to be wide so as to easily pass the club head therethrough, wherein a front surface and a rear surface of the body part 12 are brought close to and spaced apart from each other while the entrance space part 13 is contracted and expanded.

The club cover having variable internal space according to the present invention includes: a head storage space provided at an upper part of the club cover, the head storage space storing the club head; a body part provided from a middle to a lower part of the club cover and which the club head is inserted into and withdrawn from; and an entrance space part provided inside the body part, the entrance space part being configured to be wide so as to easily pass the club head therethrough, wherein the body part includes the front surface and the rear surface brought close to and spaced apart from each other. Accordingly, the club cover of the present invention is more conveniently used than conventional club covers when a club head is covered by a club cover to protect the club head and when the club head is withdrawn from the club cover to use a golf club.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Figure 1:
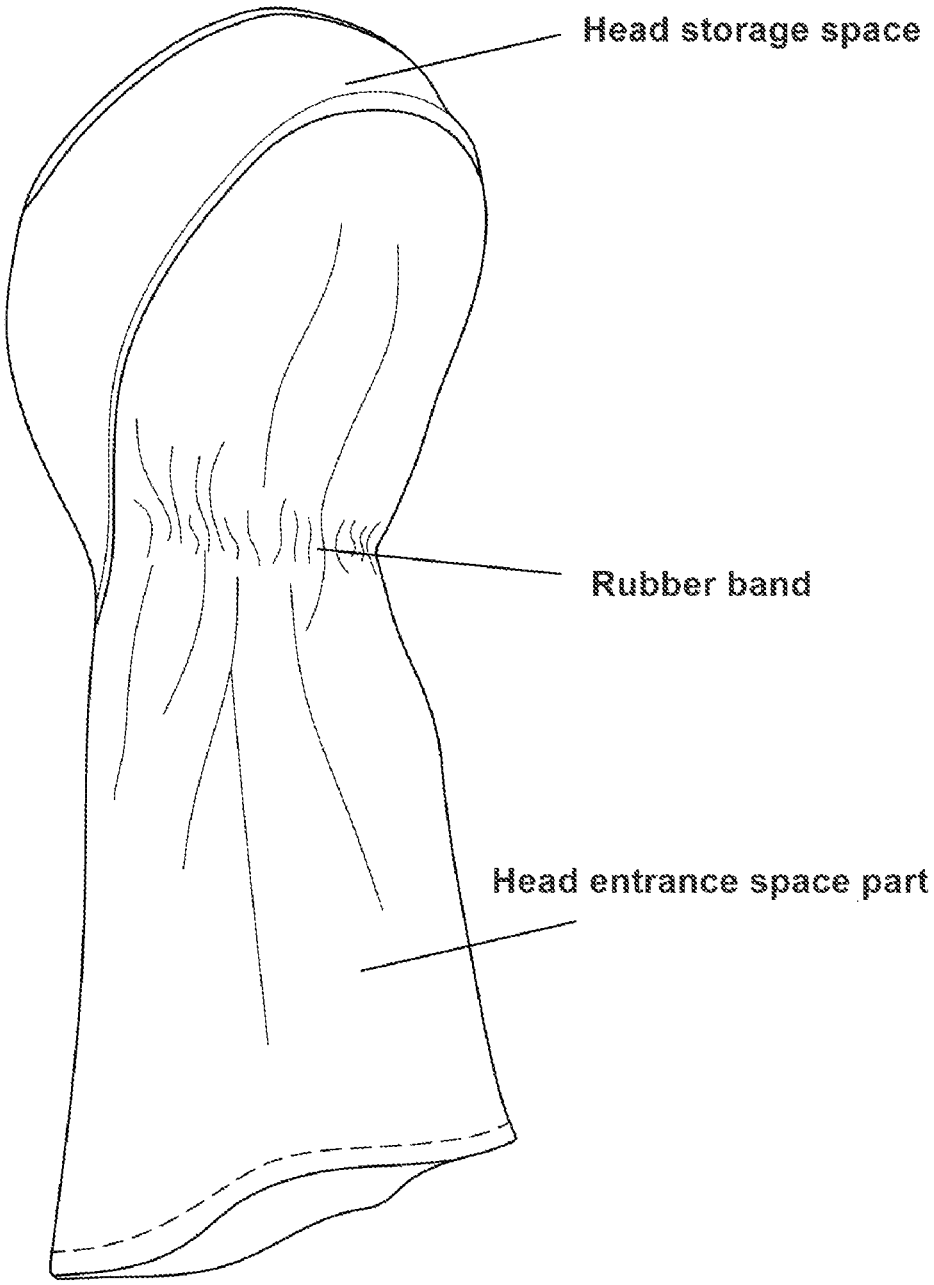
FIG. 1 is a perspective view of a conventional club cover.
Figure 2:
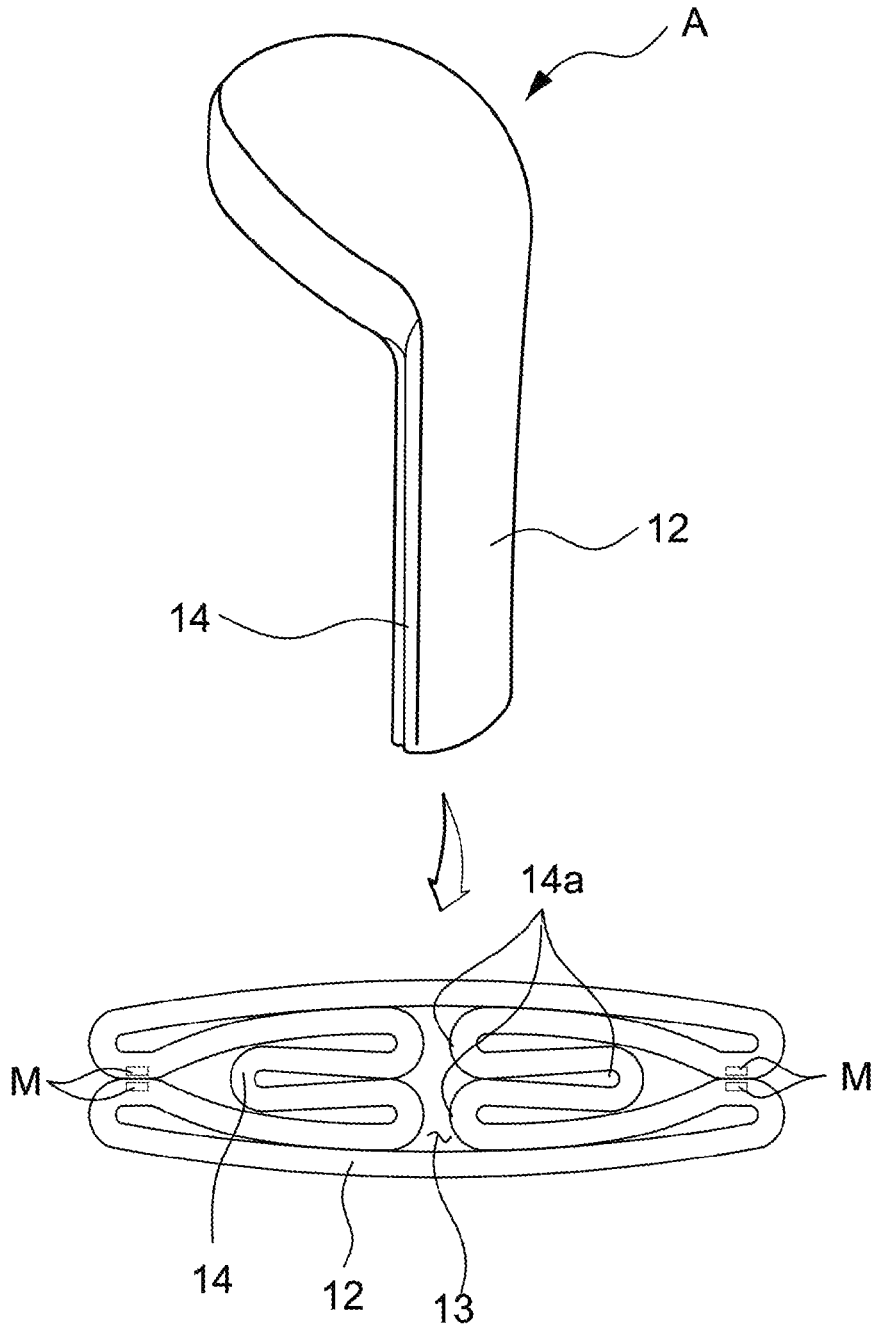
FIG. 2 is a perspective view and a cross-sectional view of another conventional club cover.
Figure 3:
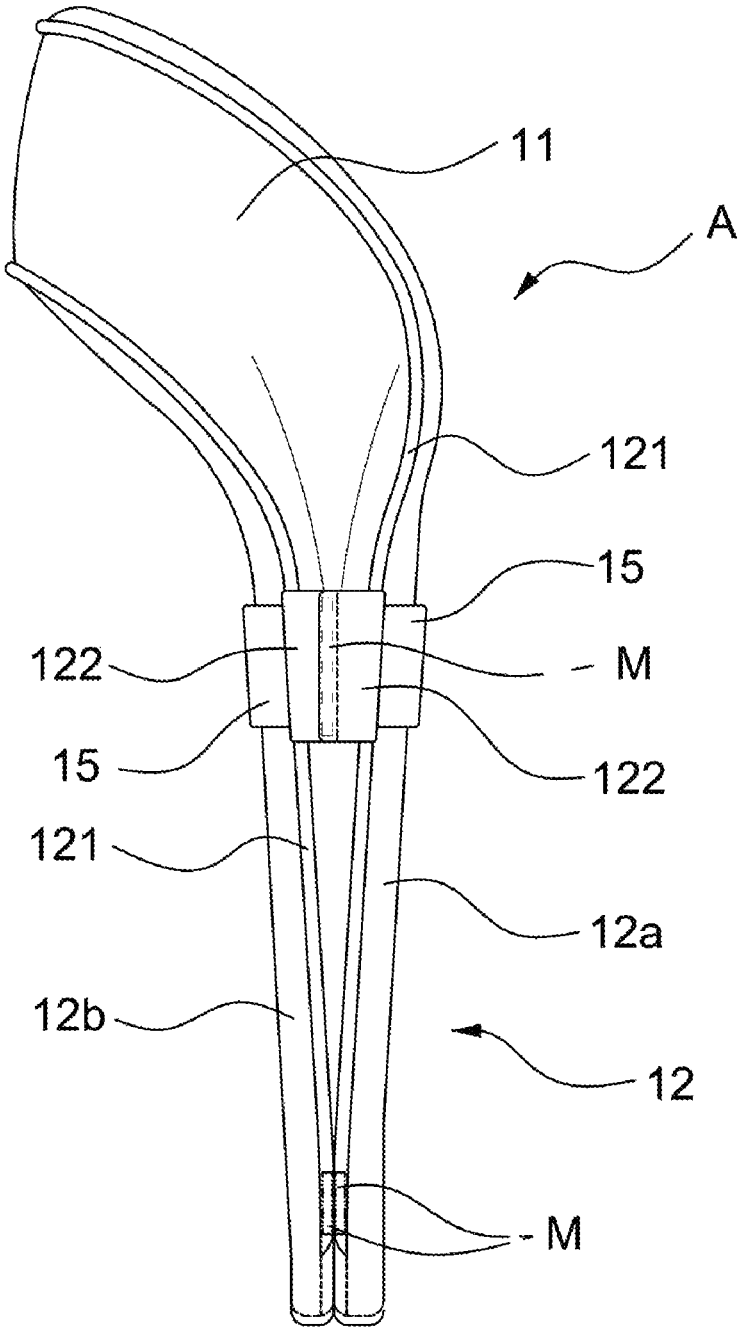
FIG. 3 is a front view of a club cover according to a first embodiment of the present invention.

As illustrated in FIGS. 3 to 8, a club cover A having variable internal space by being configured to be flexible in an entrance space part thereof according to a first embodiment of the present invention includes: a head storage space 11 provided at an upper part of the club cover, the head storage space storing the club head H; a body part 12 provided from a middle to a lower part of the club cover and which the club head is inserted into and withdrawn from; and an entrance space part 13 provided inside the body part 12, the entrance space part being configured to be wide so as to easily pass the club head therethrough.

The body part 12 includes: a front surface 12*a* and a rear surface 12*b* brought close to and spaced apart from each other while the entrance space part 13 is contracted and expanded; and side surfaces 12*c*1 and 12*c*2 connected to opposite sides of front and rear surfaces 12*a* and 12*b* therebetween.

In the embodiment of the present invention, piping parts 121 are provided at connection portions of the front surface 12*a* of the body part 12 and the side surfaces 12*c*1 and 12*c*2 and connection portions of the rear surface 12*b* and the side surfaces 12*c*1 and 12*c*2; a magnet M is inserted into a lower part of each of the piping parts 121; and a magnet pocket 122 is attached to a middle part of the piping part 121. The magnet pocket 122 is attached to the piping part 121 via a pocket connection part 122*a*, and a magnet M is inserted into a pocket 122*b* provided at an end part of the pocket connection part 122*a*.

Figure 4:
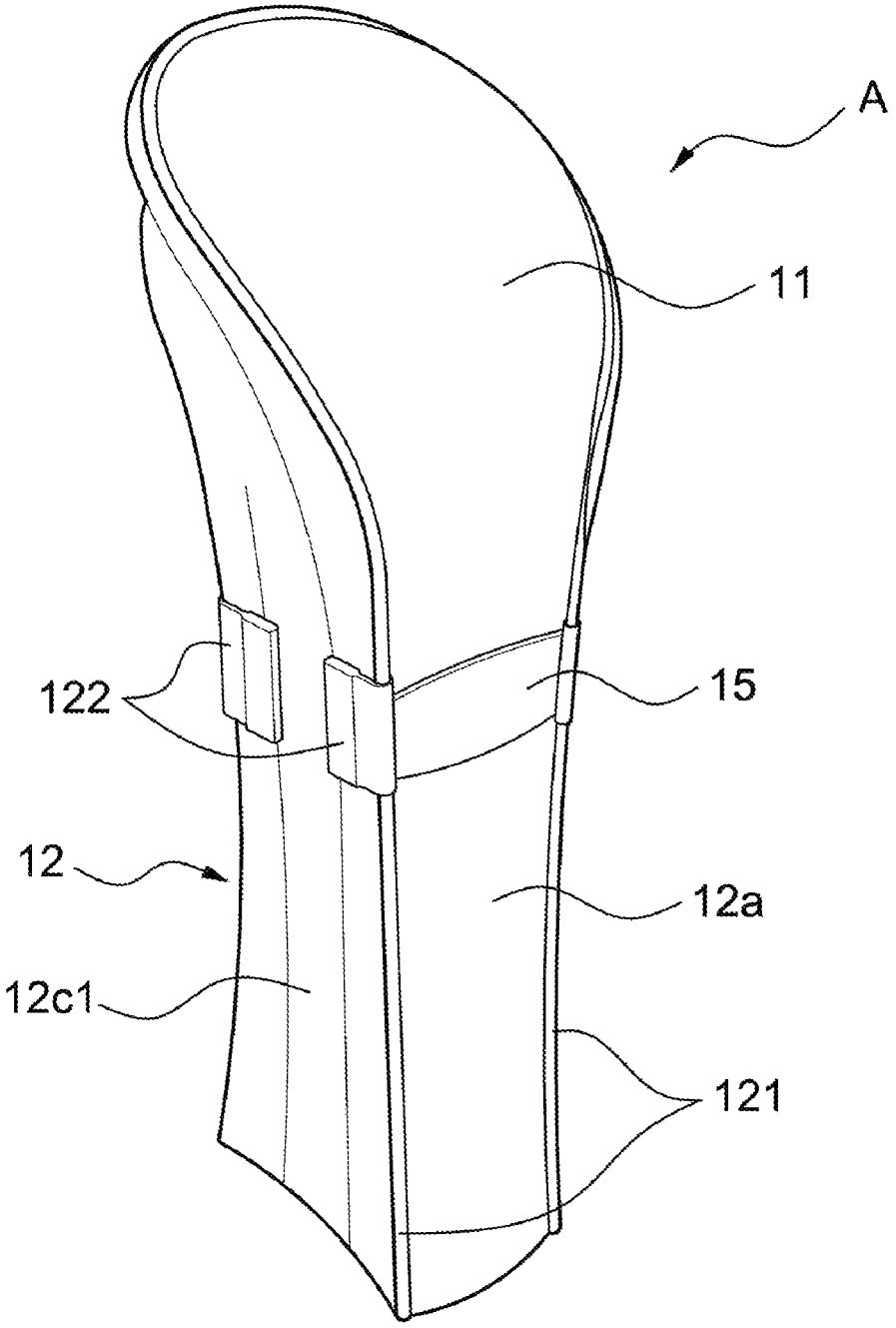
FIG. 4 is a perspective view of the club cover unfolded by being expanded according to the first embodiment of the present invention.
Figure 8:
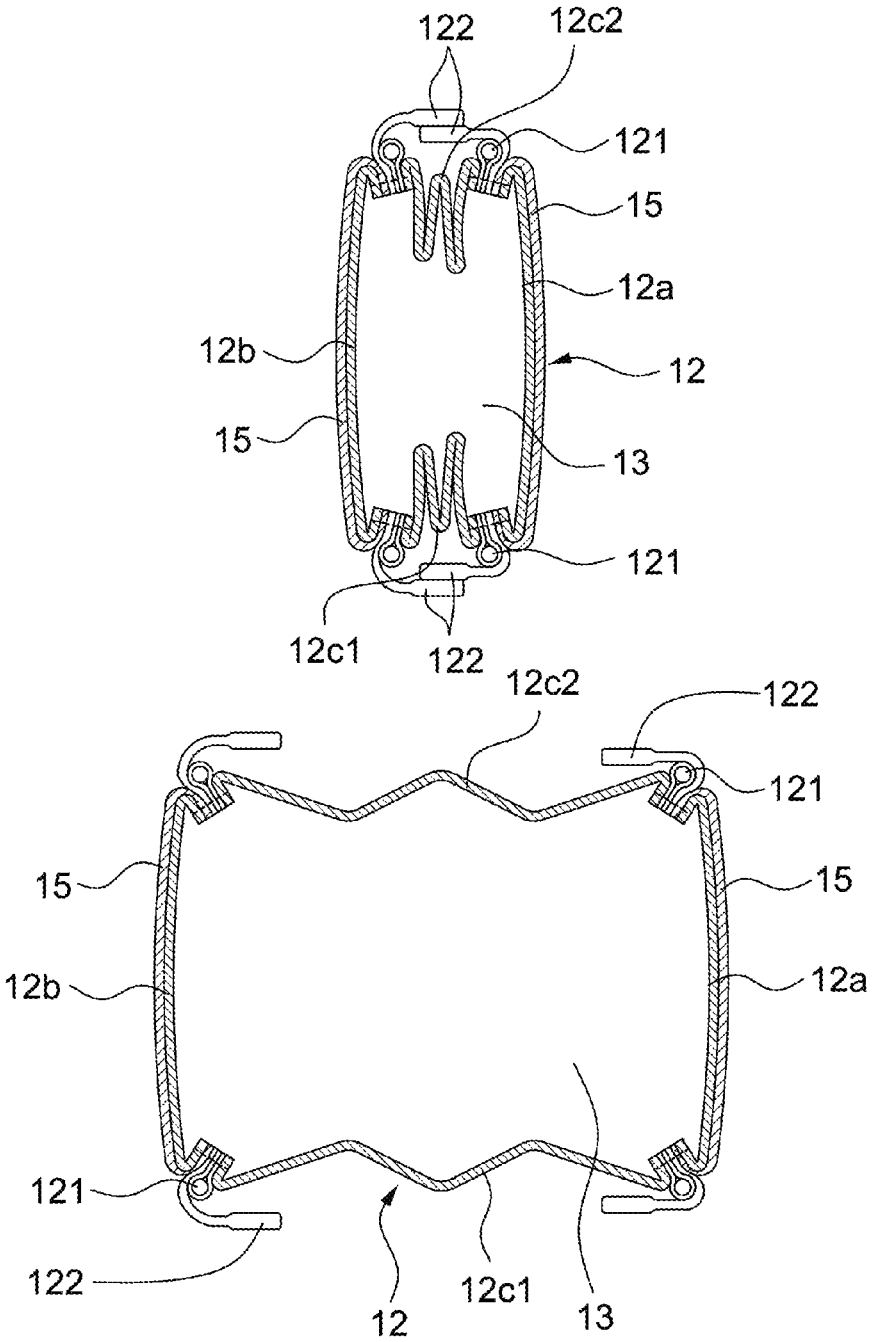
FIG. 8 is cross-sectional views illustrating the states of the expansion and contraction of the club cover according to the first embodiment of the present invention.

As illustrated in FIGS. 4 and 8, the connection part is bent such that the magnet pockets 122 attached to the middle parts of the piping parts 121 are close to each other in a direction opposing each other, so attachment between the magnets M can be efficiently performed during the contraction of the body part.

A handle 15 is provided at each of the connection portions of the front and rear surfaces 12*a* and 12*b* and the side surfaces 12*c*1 and 12*c*2, at which the magnet pockets 122 are provided, the handle being more rigid than the body part 12. The handle 15 prevents the magnet pockets 122 on the same plane from being attached to each other and allows the magnet pockets 122, which are attached to each other, to be easily separated from each other.

According to the first embodiment of the present invention having the above-described structure, the operation of the club cover A having variable internal space by being configured to be flexible in the entrance space part thereof will be described in detail hereinbelow.

Figure 5:
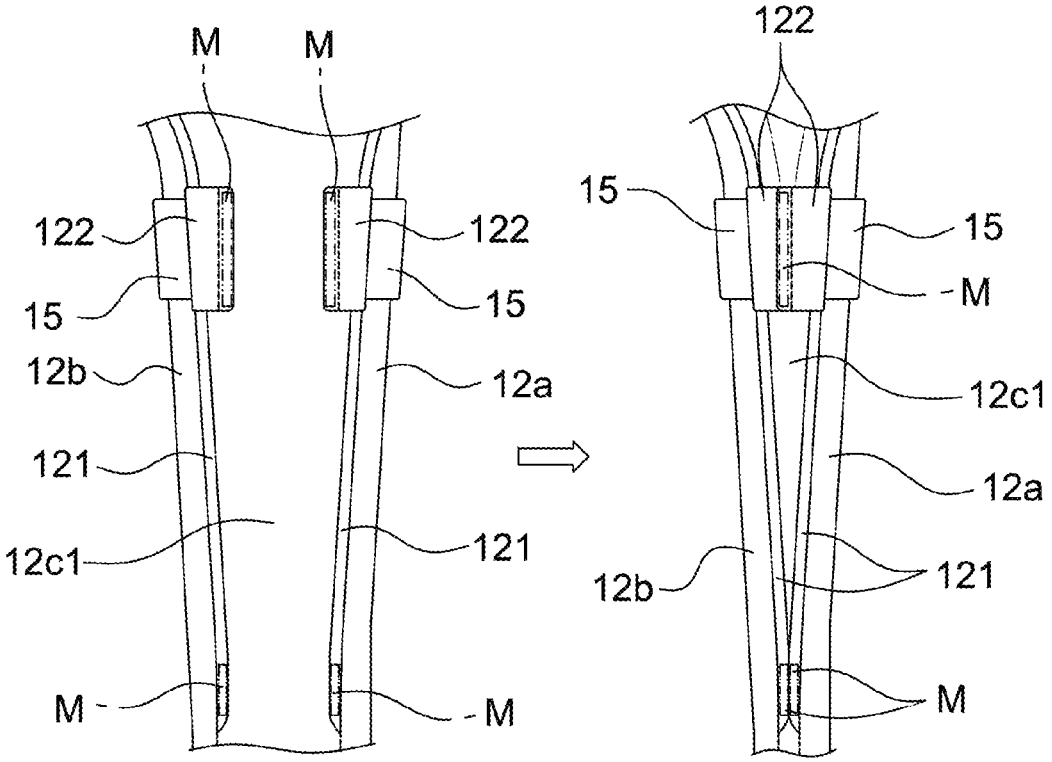
FIG. 5 is partially cut front views illustrating the states of the expansion and contraction of a body part of the club cover according to the first embodiment of the present invention.
Figure 6:
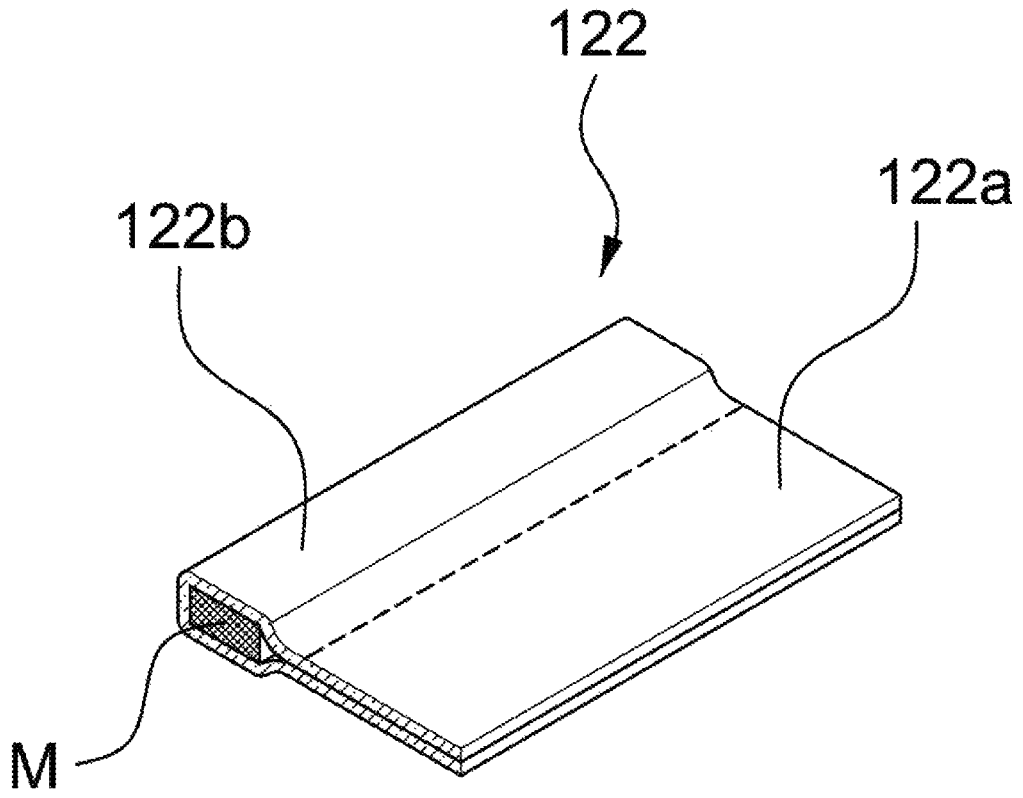
FIG. 6 is a partially cut perspective view of a magnet pocket provided in an upper part of the body part of the club cover according to the first embodiment of the present invention.
Figure 7:
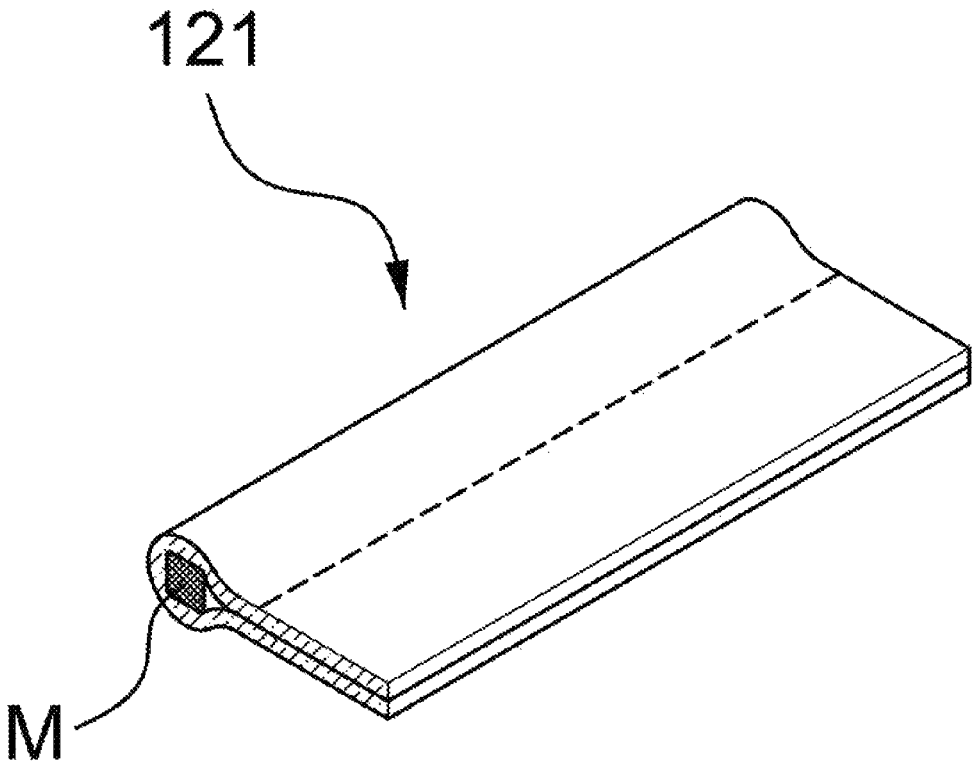
FIG. 7 is a partially cut perspective view of a magnet of a piping part provided in a lower part of the body part of the club cover according to the first embodiment of the present invention.

First, when storing the club head H in the club cover A in an empty state in which the club head H is withdrawn from the inside thereof, as illustrated in FIG. 5, the attachment of the piping parts 121 of the front surface 12*a* and the rear surface 12*b* of the body part 12 is released; the front surface 12*a* and the rear surface 12*b* are spaced apart from each other; and the body part 12 is expanded with the side surfaces 12*c*1 and 12*c*2 spread, so that the entrance space part 13 is expanded. In this state, the club head H is inserted into the club cover. Then, the body part 12, which is expanded, is pushed by an external force to be contracted; the side surfaces 12*c*1 and 12*c*2, which are spread, are folded; and the front surface 12*a* and the rear surface 12*b* of the body part 12, which are spaced apart from each other, are brought close to each other.

In this case, while the magnet pockets 122 of middle parts of the piping parts 121 opposed to each other formed on edges of the front surface 12*a* and the rear surface 12*b* are brought close to each other, the magnets M of the magnet pockets 122 are attached to magnets M of magnet pockets 122 of the body part 12 of the opposing side arranged at positions corresponding thereto. Accordingly, the opposing piping parts 121 of the positions corresponding to each other are easily and efficiently attached to each other. While the magnets M of the lower parts of the piping parts 121 are also brought close to each other, the magnets M are attached to each other and the entrance space part 13 of the body part 12 is contracted, so the club head H is stored in the club cover A.

On the contrary, when withdrawing the club head H from the club cover A with the club head H stored therein, an external force is applied in a direction in which the front surface of a body 12*a* and the rear surface of a body 12*b* move away from each other while the magnets M of the magnet pockets 122 and the magnets M of the piping parts 121 are attached to each other. The magnets M attached to each other are separated from each other, and the entrance space part 13 of the body part 12 is expanded. Accordingly, the club head H can be withdrawn from the inside of the club cover A through the entrance space part 13, which is easily expanded.

A distance spaced apart between each of the magnets M of the piping parts 121 is configured to be minimized. Accordingly, the magnets are attached to each other even by the small number of the magnets and thus the number of the magnets used can be reduced, so manufacturing cost is reduced. Furthermore, since the piping parts 121 are attached to each other, there is no open space therebetween, so foreign matter is prevented from being attached to the side surfaces of the club cover and from being introduced into the club cover, whereby there is no risk of malfunction and the appearance of the club cover A is clean and beautiful.

Figure 9:
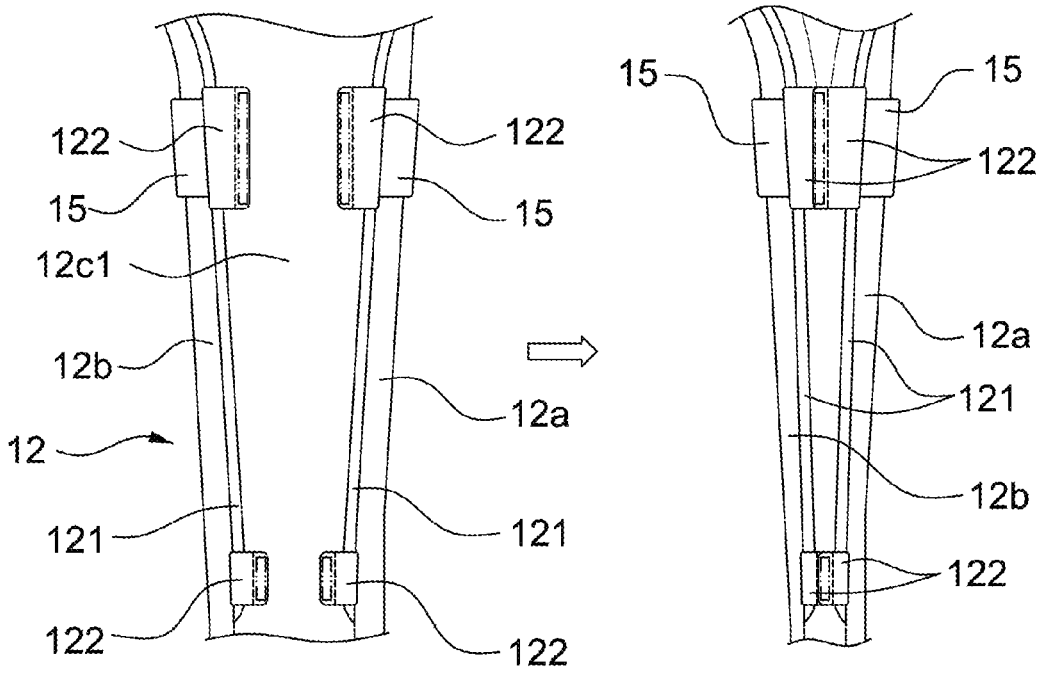
FIG. 9 is partially cut front views illustrating the states of the expansion and contraction of a body part of a club cover according to a second embodiment of the present invention.

FIG. 9 is partially cut front views illustrating the states of the expansion and contraction of a body part of a club cover according to a second embodiment of the present invention. Magnet pockets 122 are configured to be attached to lower parts and middle parts of the piping parts 121, respectively, by being spaced apart from each other at the lower parts and the middle parts of the piping parts 121. The entrance space part 13 provided inside the body part 12 is configured to be expanded and contracted by the detachment and attachment of the magnets M inserted into the pockets 122*b* of the magnet pockets 122.

Figure 10:
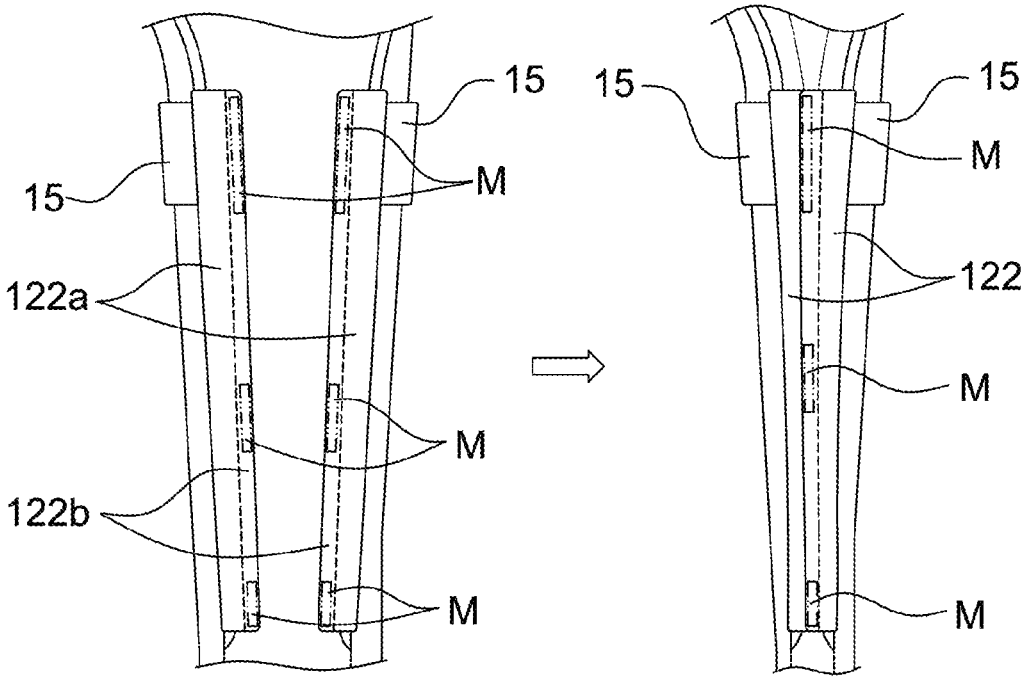
FIG. 10 is partially cut front views illustrating the states of the expansion and contraction of a body part of a club cover according to a third embodiment of the present invention.

FIG. 10 is partially cut front views illustrating the states of the expansion and contraction of a body part of a club cover according to a third embodiment of the present invention. In the embodiment, as for a slanting magnet pocket 122 attached to each of piping parts 121, a magnet M is stored in a pocket 122*b* provided at an extending edge of a pocket connection part 122*a* as a single piece attached to the piping part 121 by extending to be slanted by the interval between opposing magnet pockets becoming bigger toward a middle part from a lower part thereof.

As for the slanting magnet pockets 122, when the slanting magnet pockets opposing each other at opposite sides of the club cover are attached to each other, there is no space therebetween for dust or foreign materials to be inserted to, so the club cover A can be kept in a clean state.

Figure 11:
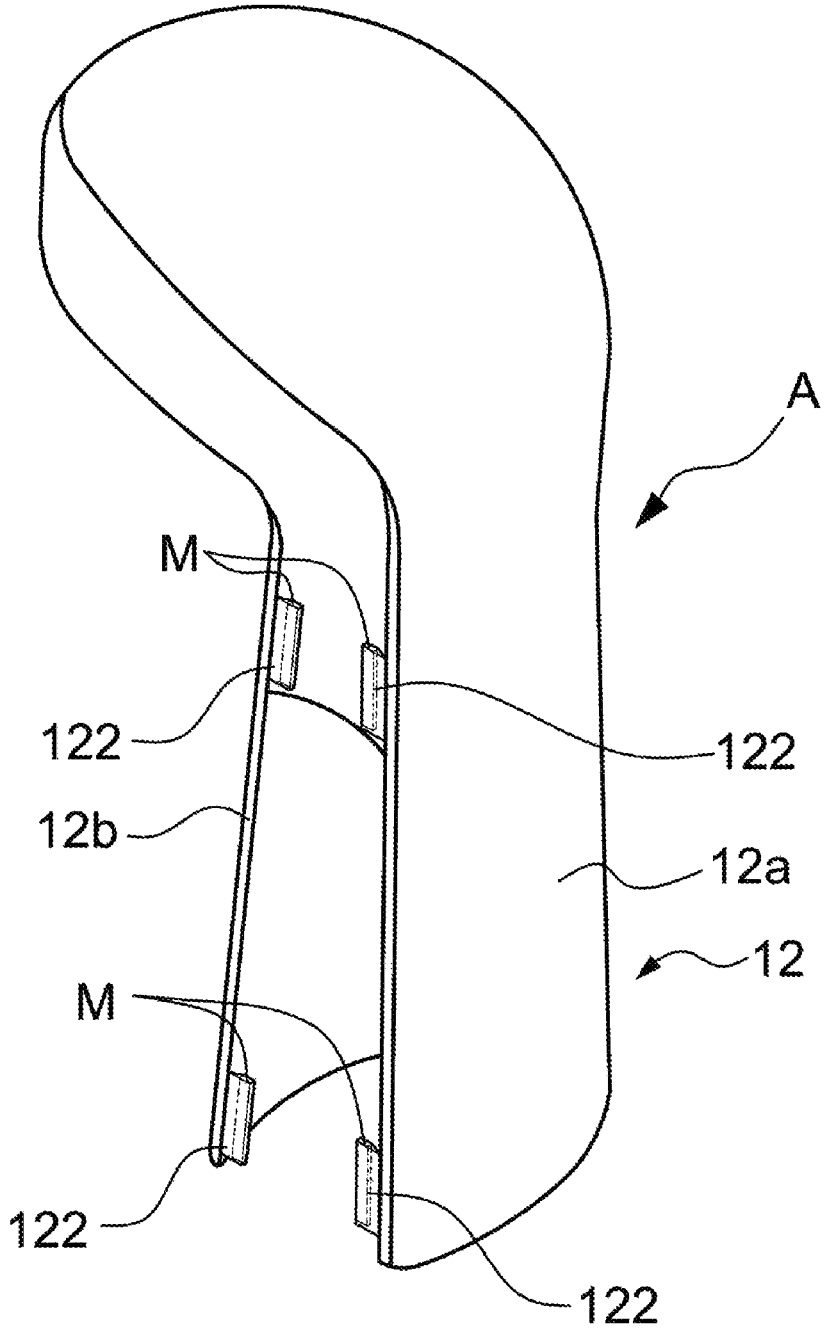
FIG. 11 is a perspective view of a club cover unfolded by being expanded according to a fourth embodiment of the present invention.

FIG. 11 is a perspective view of a club cover unfolded by being expanded according to a fourth embodiment of the present invention. In the embodiment, a cut part 16, in which the side surfaces 12*c*1 and 12*c*2 of a middle part of the body part 12 are entirely cut out, is formed. Accordingly, the club cover is configured to perform the function thereof by using only the front surface 12*a* and the rear surface 12*b*. Although not shown, a mesh structure may be provided on the side surfaces 12*c*1 and 12*c*2.

In addition, instead of the magnets M or the magnet pockets 122 mounted to the piping parts 121, a connection means such as Velcro tape or a snap button may be used.

Figure 12A:
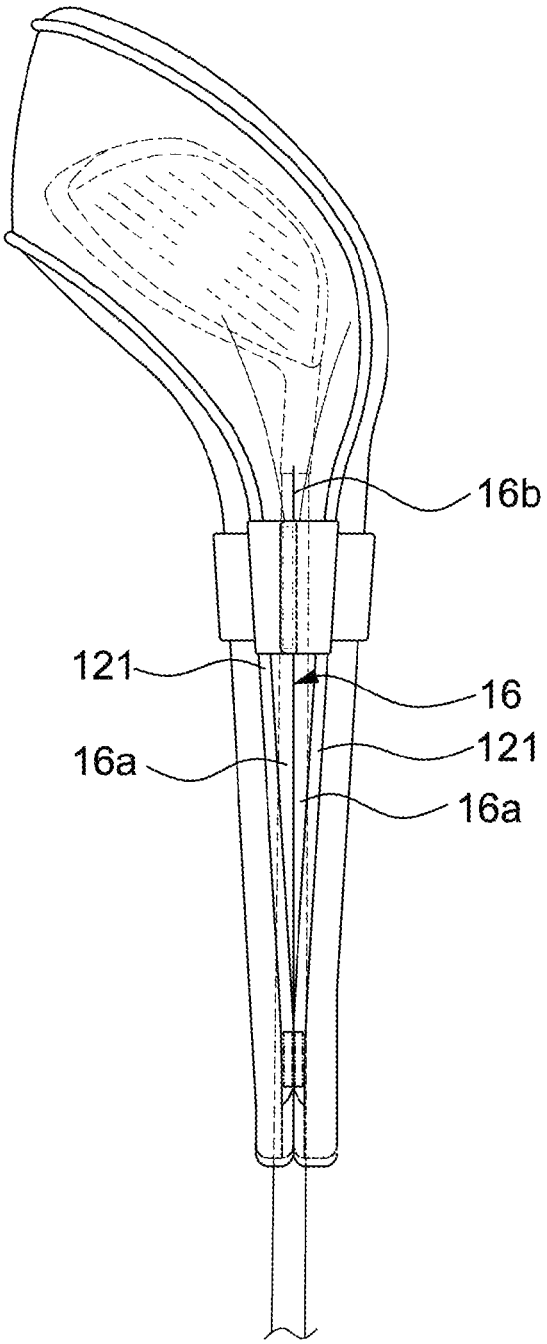
FIGS. 12A and 12B are a front view of a club cover during contraction and a front view of the club cover during initial expansion, respectively, according to a fifth embodiment of the present invention.
Figure 12B:
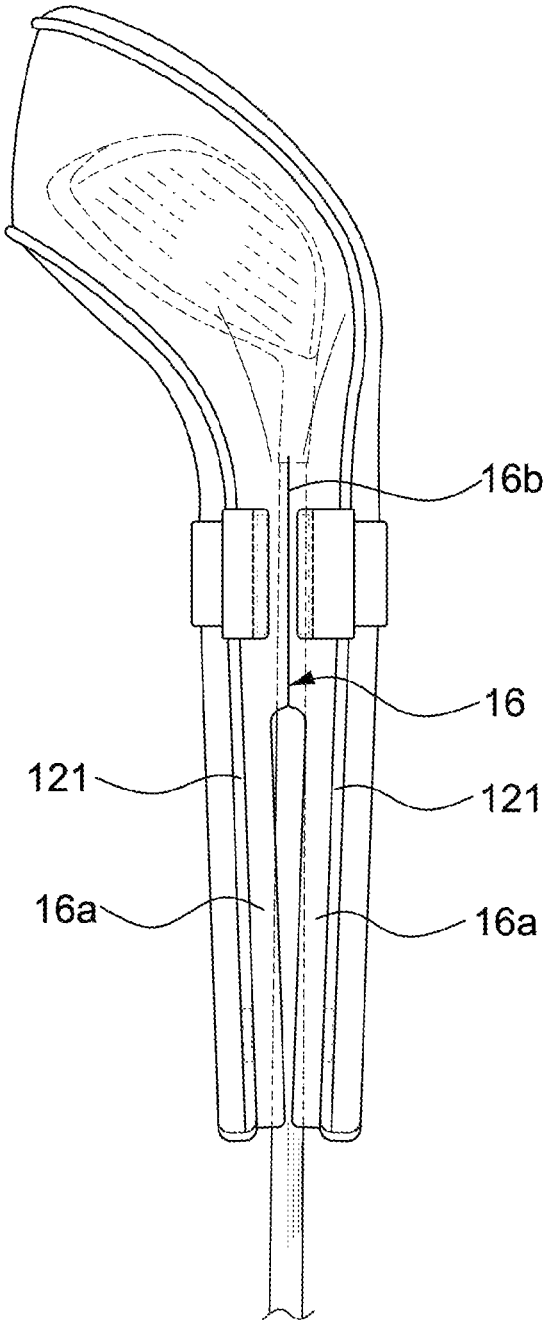
Figure 13:
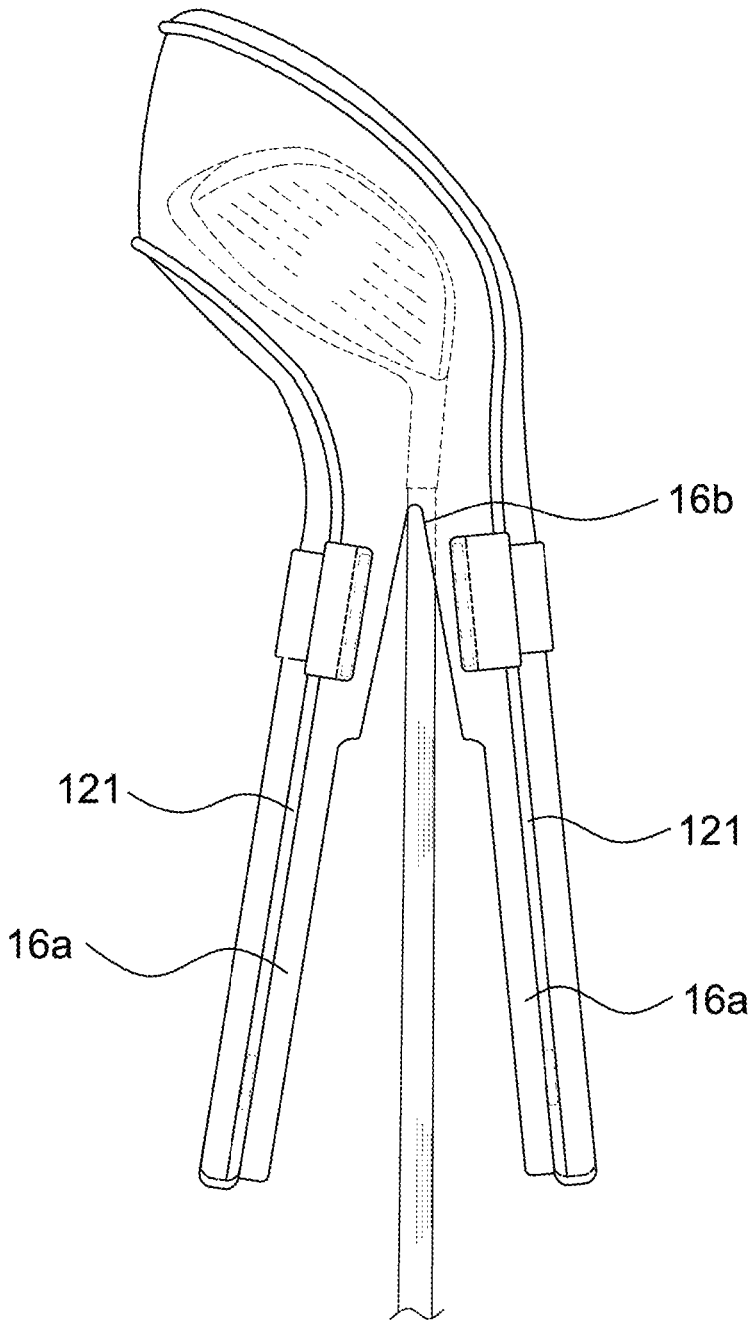
FIG. 13 is a front view of the club cover unfolded by being expanded according to the fifth embodiment of the present invention.

FIGS. 12A, 12B, and 13 are front views of a club cover according to a fifth embodiment of the present invention. The cut part 16 is formed such that an extending protection part 16*a* extending from each of the piping parts 121 to the inside thereof is maintained; a cut-open part 16*b* is formed at an upper part of the cut part 16; and the magnet pocket 122 is configured to be still attached to the piping part.

In the embodiment, the extending protection part 16*a* is maintained by extending by the width of 1 cm from each of the piping parts 121 to the center s of the body part 12; the remaining part is cut to form the cut part 16; and the cut-open part 16*b* is formed along the center s of the body part 12 at an end part of the extending protection part 16*a*.

In the club cover A having such a structure, when the front surface 12*a* and the rear surface 12*b* are pulled to the outside, the cut part 16 is opened as illustrated in FIG. 13, and then the cut-open part 16*b* is also opened, and thus the storage space for a big club head H is formed. Accordingly, the club head H can be easily introduced into or withdrawn from the head storage space 11.

Figure 14A:
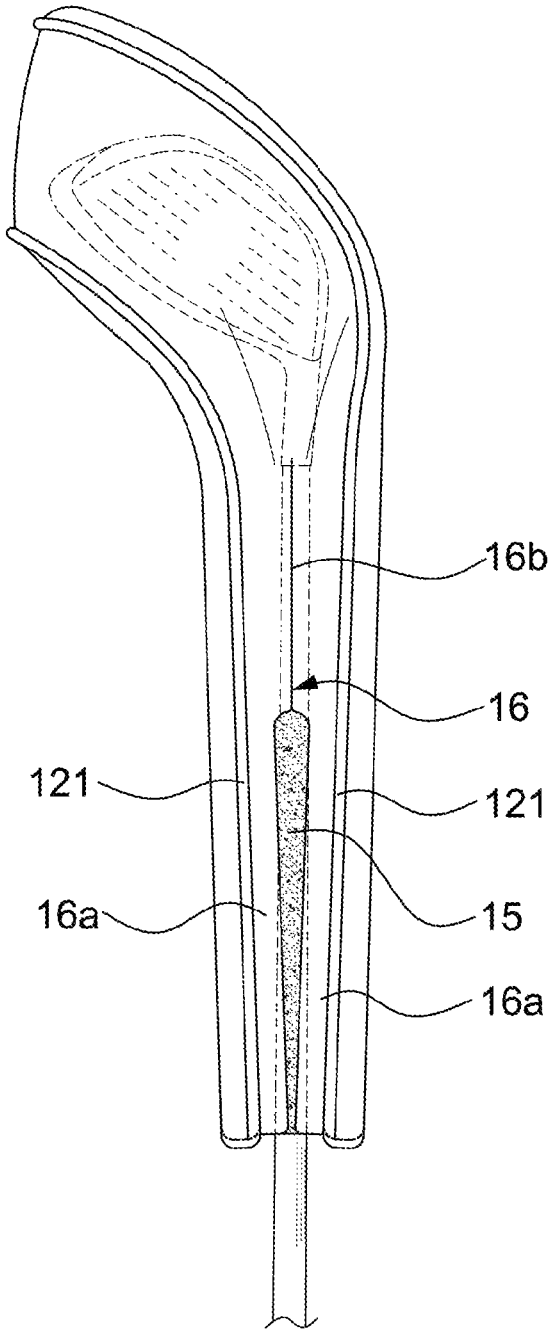
FIGS. 14A and 14B are a front view of the contracted position of a club cover and a front view of the expanded position of the club cover, respectively, according to a sixth embodiment of the present invention.
Figure 14B:
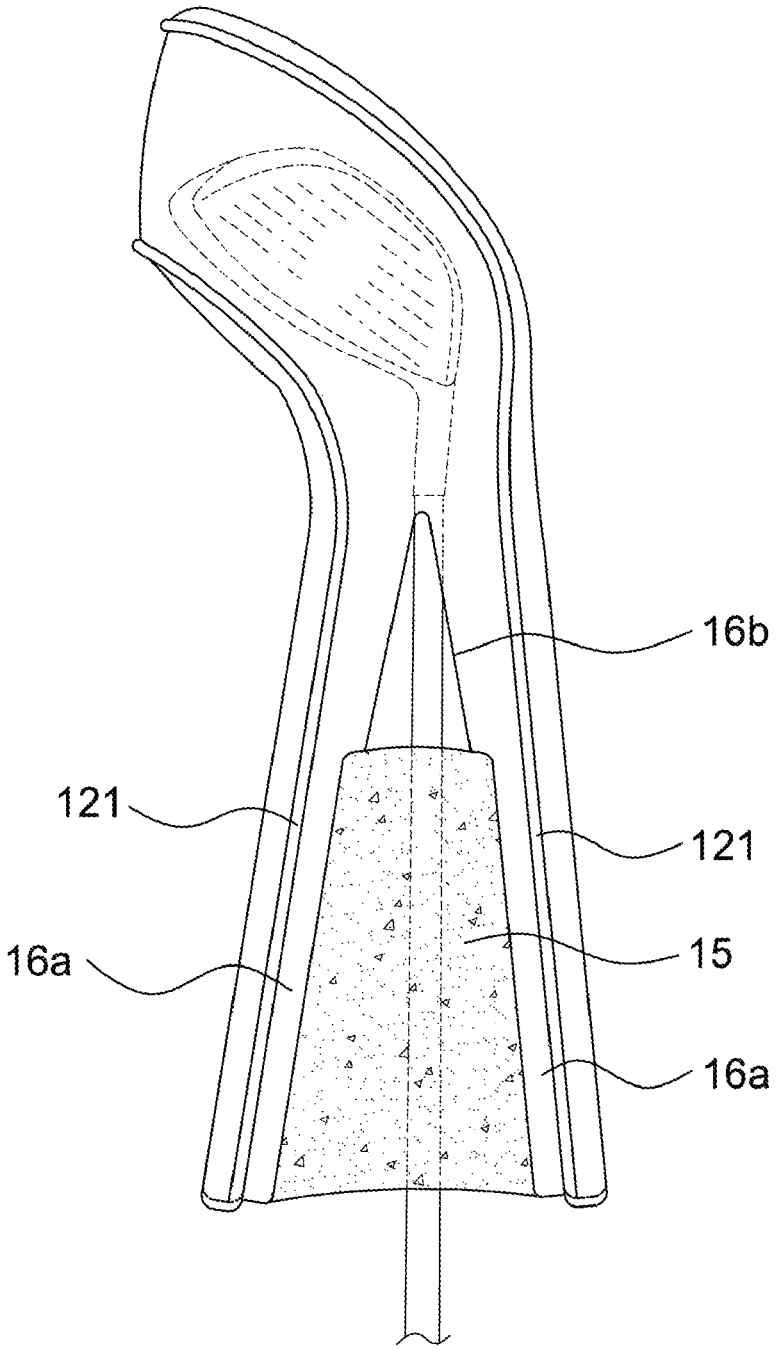

FIGS. 14A and 14B are a front view of the contracted position of a club cover and a front view of the expanded position of the club cover, respectively, according to a sixth embodiment of the present invention. A flexible spandex fabric is attached to the cut part 16 of an inner side of the extending protection part 16*a* extending inward from each of the piping parts 121. Accordingly, the contracted position of the front surface 12*a* and the rear surface 12*b* can be extended. That is, when a flexible spandex fabric 15 is attached to the cut part 16 of the inner side of the extending protection part 16*a* as illustrated in FIGS. 14A and 14B, normally, the flexible spandex fabric 15 is arranged in a contracted state and the club head H is stored in the club cover A. When the club head H is withdrawn, the front surface 12*a* and the rear surface 12*b* are pulled. Then, while the spandex fabric 15 is extended, an interval between the front surface 12*a* and the rear surface 12*b* of the body part 12 is increased to allow the club head H to easily pass therebetween, so that the club head H can be easily withdrawn and after the withdrawal of the club head H, the spandex fabric 15 is contracted again and restored to the contracted position.

As described above, in the club cover having variable internal space according to the present invention, the front and rear surfaces of the body part are spaced apart from and brought close to each other. Accordingly, the club head can be easily withdrawn and safely stored without damage.

The club cover having variable internal space according to the present invention can be efficiently applicable to the club cover manufacturing industry, since it is possible to manufacture homogeneous products in the club cover manufacturing industry.

What is claimed is:

1. A club cover (A) having variable internal space, the club cover comprising:

a head storage space (11) provided at an upper part of the club cover, the head storage space storing the club head (H);

a body part (12) provided from a middle to a lower part of the club cover and which the club head is inserted into and withdrawn from; and an entrance space part (13) provided inside the body part (12), the entrance space part being configured to be wide so as to easily pass the club head therethrough wherein the body part (12) includes a front surface (12*a*), a rear surface (12*b*), and side surfaces (12*c*1, 12*c*2) provided between the front and rear surfaces (12*a*, 12*b*), so that the entrance space part (13) is expanded and contracted while the side surfaces (12*c*1, 12*c*2) are unfolded and folded such that the front surface (12*a*) and the rear surface (12*b*) are spaced apart from and brought close to each other, and wherein a piping part (121) is provided at each of connection portions between the front surface (12*a*) of the body part (12) and the side surfaces (12*c*1, 12*c*2) and connection portions between the rear surface (12*b*) and the side surfaces (12*c*1, 12*c*2), wherein a magnet (M) is inserted into a portion of the piping part (121), or a magnet pocket (122) provided by hanging a pocket on the piping part (121) and storing a magnet (M) in the pocket is attached to the piping part (121).

2. The club cover of claim 1, wherein the magnet pockets (122) opposing each other are attached to the piping parts opposing each other by extending slantingly such that an interval between the magnet pockets and an interval between the piping parts are increased toward the upper part of the club cover, at which the club head is located, from a lower part thereof, or the magnet pockets (122) are attached to the piping part to be spaced apart from each other at the lower part and the middle part of the club cover.

3. The club cover of claim 1, wherein the magnet pocket (122) is attached to a middle part of the piping part (121), and the magnet (M) is inserted into a lower part of the piping part (121).

4. The club cover of claim 1, wherein connection means, which are detachably combined with each other, are used instead of using the magnet (M) inserted into the portion of the piping part (121) or the magnet pocket (122).

5. The club cover of claim 1, wherein the side surfaces (12*c*1, 12*c*2) are configured to be partially cut out.

6. The club cover of claim 5, wherein a cut-open part (16*b*) is provided at an upper part of a cut part (16) cut partially in the side surfaces (12*c*1, 12*c*2).

7. The club cover of claim 6, wherein a flexible spandex fabric (15) is attached to the cut part (16) of each of the side surfaces (12*c*1, 12*c*2) such that a lower part of each of the front surface (12*a*) and the rear surface (12*b*) is extended bigger than an upper part thereof and is contracted, so an interval between the front surface (12*a*) and the rear surface (12*b*) is changed.

8. The club cover of claim 5, wherein a flexible spandex fabric (15) is attached to the cut part (16) of each of the side surfaces (12*c*1, 12*c*2) such that a lower part of each of the front surface (12*a*) and the rear surface (12*b*) is extended bigger than an upper part thereof and is contracted, so an interval between the front surface (12*a*) and the rear surface (12*b*) is changed.

9. The club cover of claim 1, wherein the side surfaces (12*c*1, 12*c*2) are configured to be partially cut out.

10. The club cover of claim 9, wherein a flexible spandex fabric (15) is attached to the cut part (16) of each of the side surfaces (12*c*1, 12*c*2) such that a lower part of each of the front surface (12*a*) and the rear surface (12*b*) is extended bigger than an upper part thereof and is contracted, so an interval between the front surface (12*a*) and the rear surface (12*b*) is changed.

11. The club cover of claim 1, wherein a handle (15) is provided at each of the connection portions of the front and rear surfaces (12*a*, 12*b*) and the side surfaces (12*c*1, 12*c*2), at which the magnet pockets (122) are provided.

* * * * *